United States Patent [19]

Kilgore

[11] 3,953,938

[45] May 4, 1976

[54] MEANS FOR SUPPORTING A TOY CRAFT

[76] Inventor: Jerry W. Kilgore, 5600 E. 3rd Ave., Gary, Ind. 46403

[22] Filed: Jan. 24, 1975

[21] Appl. No.: 543,808

[52] U.S. Cl. ..... 46/260; 46/216; 46/241; 104/93

[51] Int. Cl.[2] ..... A63H 19/24

[58] Field of Search ..... 46/201, 202, 216, 243 M, 46/243 LV; 104/93–95

[56] References Cited

UNITED STATES PATENTS

| | | | |
|---|---|---|---|
| 2,083,218 | 6/1937 | Carter | 104/93 |
| 2,551,317 | 5/1951 | Damiano | 46/216 |
| 2,825,291 | 3/1958 | Chadenson | 104/94 |
| 3,116,699 | 1/1964 | Liversidge et al. | 46/243 M |
| 3,330,066 | 7/1917 | Crawford | 46/216 |
| 3,451,161 | 6/1969 | Lemelson | 46/241 |

*Primary Examiner*—Louis G. Mancene
*Assistant Examiner*—Robert F. Cutting
*Attorney, Agent, or Firm*—Walter Leuca

[57] ABSTRACT

A means for supporting a toy craft for uninterrupted travel around a room. This invention comprises a circuitous rail mounted on the walls of a room adjacent the ceiling to avoid all the openings normally provided in a room. The rail, carries a drive train free to travel thereon. Depending from the drive train and rail is a link member having a magnet provided on the distal end thereof. The toy craft is removably held to the link member for travel with the drive train by the magnet.

8 Claims, 5 Drawing Figures

Fig.-5
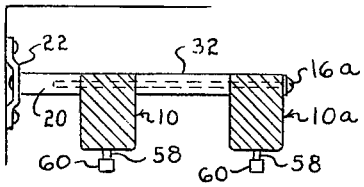
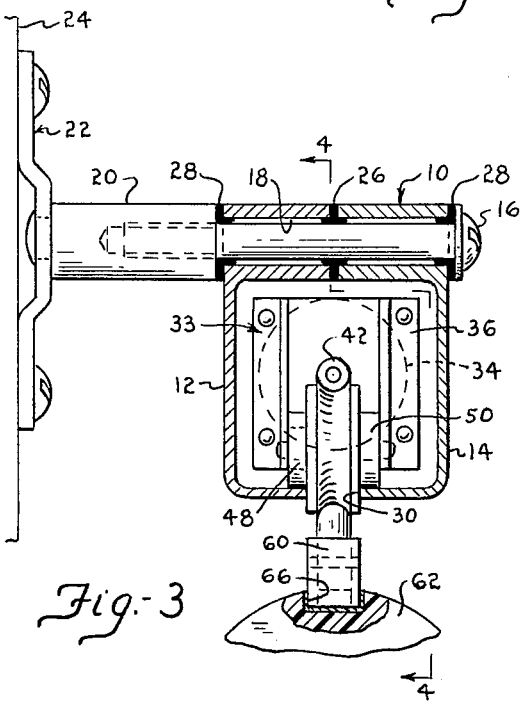
Fig.-3
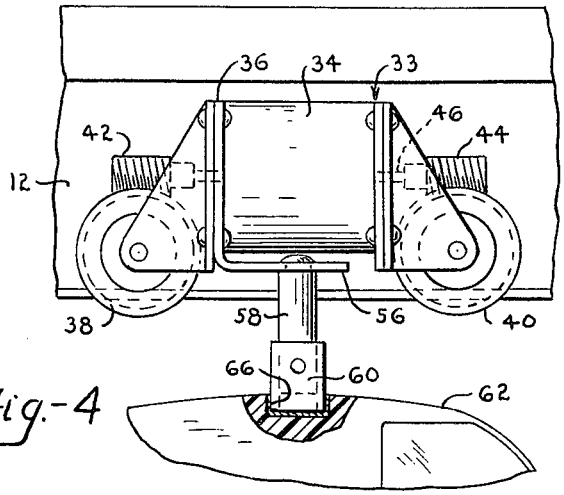
Fig.-4
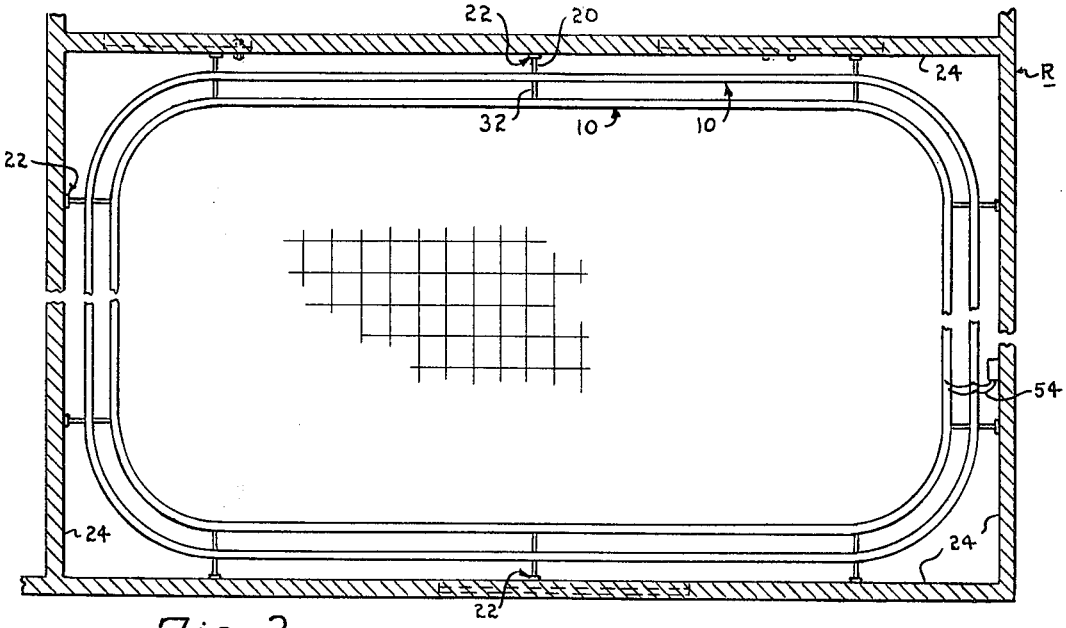
Fig.-2
Fig.-1
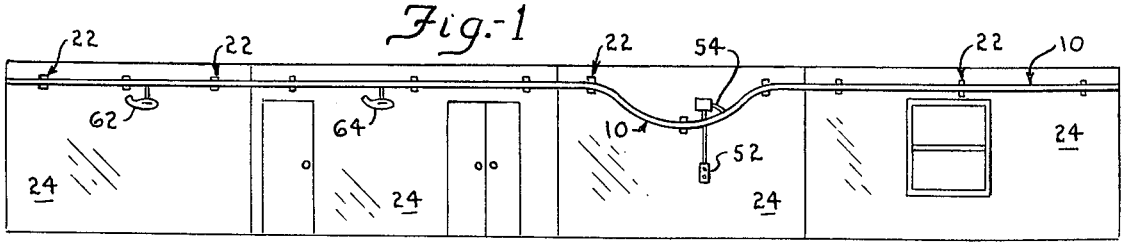

MEANS FOR SUPPORTING A TOY CRAFT

BACKGROUND OF THE INVENTION

1. Field of the Invention

This invention relates generally to toys and more particularly to a means for supporting a toy craft.

2. Description of the Prior Art

The prior art toy vehicles and tracks on which they operate are constructed and assembled for use on tables or the floor which interfere with other uses of the room in which these toys are used. Consequently, the use of such toys must be temporary and from time to time the tracks are dismantled and stored until there is a desire to use the toy vehicle and track again; otherwise, the room or portion of the room cannot be used for other purposes. Another disadvantage of the prior art devices to which this invention pertains is the fact that the crafts or vehicles operated on the track are not interchangeable since the vehicles are especially constructed to connect to the track by means of a retaining wheel or pin and slot arrangement which prevent the vehicles from leaving the track.

SUMMARY OF THE INVENTION

According to the teaching of my invention, I eliminate these two principal disadvantages of the prior art by providing a continuous or endless track or rail around the walls of the room at an elevation adjacent the ceiling. The rail is preferably enclosed and contains a drive train comprising a wheeled frame containing an electric motor and drive connected to the wheels. The electric motor is energized by traveling contacts which conduct the electric current from the rails or the wheels themselves serve as conductors to energize the drive motor. These methods are known to the prior art and the details thereof are not part of my invention. A continuous slot is provided on the underside of the rail through which a link member depends from the drive train. The distal end of the depending line member is provided with holding means such as a magnet. The toy craft of my invention is provided at the top side thereof with a magnetic attracting surface such as an iron or steel sheet member whereby the craft is connected to the link member by placing the sheet member portion against the magnet end of the link member. The toy craft is thereby held in place only by the magnetic attraction of the magnet. When it is desired to change the type of vehicle, whether automotive, aircraft or spacecraft vehicles, all that will be required is to pull the present craft from its magnetic mooring and place a similarly adapted craft to the distal end of the link member. Rails of my invention may be more than one, side by side or vertically spaced, so that multiple crafts may be driven in race competition. The rail installation is mounted on the walls of a room adjacent the ceiling thereof and may be a permanent installation to remain in the room ready for use without interfering with other uses of the room.

Other objects and advantages of my invention will become more apparent after a more careful study of the following description when read with reference to the accompanying drawing in which is disclosed a preferred embodiment of my invention.

BRIEF DESCRIPTION OF THE DRAWING

FIG. 1 is a panoramic view of four walls of a room illustrating the position of the rails of this invention supported on the walls;

FIG. 2 is a top view of the rail of this invention shown supported on the walls of a room sectioned below the ceiling;

FIG. 3 is a sectioned end view of a rail showing the interior thereof and its means of connection to the wall bracket, and showing the toy craft in fragment magnetically connected to the drive train in the rail;

FIG. 4 is a side view of this invention taken along line 4—4 of FIG. 3, showing the drive train interior of the rail and the magnet means seated in the body of the toy craft which is shown in fragment; and FIG. 5 is an end view of a schematic of the rail of this invention showing a multiple rail assembly for supporting toy crafts for competing runs.

DESCRIPTION OF THE PREFERRED EMBODIMENT

Referring now to the drawings, the reference numeral 10 designates generally the rail of this invention. It comprises, when assembled, a rectangular tube longitudinally divided to form half sections 12 and 14, which are held together by screws 16 inserted through holes 18 spaced along the top part of the rail. The threaded ends of screws 16 are threadedly secured to stud block extensions 20 of bracket members 22 which are connected to walls 24 of room R. Brackets 22 may, of course, be in any convenient shape so as to support the track on walls 24 sufficiently spaced therefrom around room R. Insulated spacers 26 and 28 are provided between rail sections 12 and 14 of track 10, and bracket 22 to prevent grounding or shorting of the current supplied to rail 10. The bottom side of rail sections 12 and 14 do not extend toward each other for contact but are spaced from each other to form an endless slot 30 around rail 10. Rail 10, of course, is made in matching sections so that the sections are aligned end to end to form the endless or circuitous rail around room R.

FIGS. 2 and 5 illustrate double track assemblies 10 and **10*a*. The rails are shown diagramically and are identically in structure. Rail spacer sleeves 32 are provided between rails 10 and 10*a* adapted for alignment with holes 18 in rails 10 and 10*a* through which elongated screws 16*a* pass through rails 10 and 10*a* and rail spacer sleeves 32 and are terminally threaded into internally threaded stud blocks 20 of bracket 22. Therefore, as illustrated in FIG. 5, rail 10*a* may be added spaced apart by sleeve members 32 to form multiple rails mounted on the same wall brackets 22** around the room.

Hereinafter, reference will be had only to track 10 in continuing the description of the present invention, and the structure and the operation of additional rails, drive trains and toy crafts are substantially identical with the rail, drive train and toy crafts of rail 10.

The bottom horizontal portion of sections 12 and 14 of rail tube 10 being spaced and insulated from each other by insulated spacers 26 and 28, serve as current conductors to supply power to electric motor 34 supported on frame 36 forming drive train 33 which is movable in the tubular hollow of rail 10. Centrally positioned on frame 36 are gear wheels 38 and 40, which extend through slot 30 between the spaced ends of sections 12 and 14. Gear wheels 38 and 40 are supported on frame 36 in tandem relation and are driven by worm pinions 42 and 44 respectively, which are connected to common shaft 46 of motor 34. Provided on each side of gear wheels 38 and 40 are current pick-up wheels 48 and 50 (FIG. 3). Gear wheels 38 and 40 extending through slot 30 of rail 10 serve to guide drive train 33 centrally in tubular rail 10. I form gear wheels 38 and 40 from non-conducting material and side wheels 48 and 50 are formed from electric conducting material so that the current passing through sections 12 and 14 of rail 10 may be conducted to motor 34 by means of side wheels 48 and 50, whereby motor 34 is energized to drive gear wheel units 38 and 40. I accomplish this by insulating side wheels 48 and 50 from all its support members except sections 12 and 14 of rail 10. I conduct current from side wheels 48 and 50 to motor 34 by current pick up brushes (not shown) in contact with side wheels 48 and 50 and which are wired to the circuit of motor 34. The details thereof are not shown since this method and means of energizing an electric motor are well known to one skilled in the art. Rail sections 12 and 14 are connected to a voltage source 52 by circuit 54 as shown in FIGS. 1 and 2. It will be noted in FIG. 1 that voltage source 52 is in the form of a switch by which means electric current may be conveniently turned on and off.

Motor frame 36 of drive train 33 is provided with a centrally positioned bracket member 56 to which is connected bar 58 which depends downwardly through slot 30. The distal end of bar 58 is provided with means such as magnet 60 preferably having a rectangular cross-section. I provide in combination with rail 10 and drive train 33, a toy aerocraft 62 and, if multiple rails are provided, a competing craft 64 (shown only in FIG. 1), whether in the form of space crafts or conventional flying crafts or any other type such as a vehicular craft. The top part of toy crafts 62 and 64 is provided with a rectangular detented seat 66 from material such as sheet metal or the like as shown in FIGS. 3 and 4 to match the rectangular configuration of magnet 60 so that magnet 60 readily fits in the sheet metal seat 66 of the crafts. Sufficient clearance should be provided between magnet 60 and its seat 66 so that crafts 62 and 64 may readily be attached onto magnet 60. The holding connection between crafts 62, 64 and magnets 60 is the magnetic attraction of the magnet to the sheet metal lining forming seat 66. It is understood, of course, if the crafts 62 and 64 are formed from sheet metal material, it would not be necessary to provide sheet metal lining for seat 66 since the material that the toy craft is made from would be magnetically attracted to magnet 60. Toy crafts 62 (and 64) may be connected to magnet 60 merely by placing the body of the craft against magnet 60; and when it is desired to remove the craft therefrom, the craft may simply be pulled from its magnetic mooring and no other connecting link is necessary. Though it is not necessary, I prefer to provide a simple geometric outlined recess for seat 66 for magnet 60 so that the craft may be maintained in a fixed longitudinal position relative to its driven direction.

In FIG. 1, I show rail 10 as having a curve shown as a decline and an incline. Though it would not be necessary, the low point on the curve of rail 10 may serve as a station at which point a child may be able to reach and remove toy craft 62 (64) when it is desired to exchange for other type crafts. This is accomplished simply by pulling the craft from the magnetic attraction of magnet 60. The vertically sloped curve, besides being used as a craft removing and replacing station, will give the appearance of craft 62 (64) of diving and ascending. Such a curve in rail 10 obviously should be on a wall of the room or portion thereof, which contains no openings such as doors.

Though the preferred embodiment of my invention is the use of magnet 60 to provide holding means for crafts 62 and 64, it is understood that my invention contemplates the use of holding means which accomplishes the act of holding merely by placing the toy craft in contact with the holding means; one of the objects of this invention being to allow toy crafts to be easily removed and replaced with different types of crafts without requiring the toy crafts to be manufactured with special connecting means to accommodate or mate with the holding means. As an example, an ordinary toy craft, if not made from magnetic attracting materials such as sheet steel and if made from plastic materials, may be adapted to be supported by magnet 60 merely by connecting, such as by gluing at the appropriate place thereon, a piece of sheet metal which will serve as the magnetically attracting seat for magnet 60. This can be accomplished very simply without changing the structure of the toy craft. Examples of non-magnetic holding means are fibrous and non-drying adhesive surfaces provided in place of a magnet element.

I claim:

1. A toy device comprising:
- a rail supported on the walls of a room;
- a drive device on said rail free to travel on said rail;
- a bar member extending from said drive device, the distal end of said bar member being spaced from said rail;
- a magnet provided on the distal end of said bar member;
- a toy craft; and
- a magnet attracting member on said toy craft, said craft being held to said magnet at said magnet attracting member solely by the magnetic pull of said magnet.

2. A toy device comprising:
- a rail supported on the walls of a room;
- a drive device on said rail free to travel on said rail;
- a bar member extending from said drive device, the distal end of said bar member being spaced from said rail; and
- a toy craft having a magnet means attached to said bar member at said magnet means and held thereto solely by the magnetic pull of said magnet means.

3. The toy device of claim 2 wherein said rail is further characterized as being circuitous.

4. The toy device of claim 2 wherein said rail is further characterized as being supported on the walls of a room by means of brackets to space said rails from said walls, and positioned on said walls above any openings in said walls.

5. The toy device of claim 2 wherein said drive device is further characterized as being electrically powered.

6. The toy device of claim 3 wherein said rail is further characterized as being a tubular structure and having a slot opening therearound.

7. The toy device of claim 5 wherein said drive device is further characterized as being on said rail interior of said tubular structure, and said bar member extending from said drive device through said slot opening of said tubular structure.

8. A means for supporting a toy craft for travel in a room having openings in the walls thereof comprising:

a circuitous rail, said circuitous rail being longitudinally separated by electric non-conducting material;

said longitudinally separated parts of said rail being electrically energized;

an electric motor drive means on said rail completing the circuit of said electrically energized longitudinal parts of said rail to operate the motor of said drive means for travel therearound;

means for supporting said circuitous rail in said room above the openings in the walls of said room; and means connecting said motor drive means extending from said rail for supporting said toy craft.

* * * * *